United States Patent [19]

Bohnen et al.

[11] Patent Number: 4,788,453

[45] Date of Patent: Nov. 29, 1988

[54] ARRANGEMENT FOR THE LOGICAL INTERLINKAGE OF MECHANICAL SIGNALS

[75] Inventors: Peter Bohnen; Ludvik Godesa; Reinhard Kugler; Ulrich Marquardt, all of Berlin, Fed. Rep. of Germany

[73] Assignee: Siemens Aktiengesellschaft, Munich, Fed. Rep. of Germany

[21] Appl. No.: 26,741

[22] Filed: Mar. 17, 1987

[30] Foreign Application Priority Data

Mar. 27, 1986 [DE] Fed. Rep. of Germany ..... 3611020

[51] Int. Cl.[4] ..... H01H 9/26

[52] U.S. Cl. ..... 307/119; 307/120; 200/331; 335/161; 74/483 R

[58] Field of Search ..... 307/119, 120, 132 R, 307/132 B, 132 ER; 337/48, 49; 74/501 R, 110, 828, 483 R, 522 R; 361/1, 102; 200/16 B, 5 B, 5 EB, 5 EA, 5 R, 6 BA, 50 R, 50 B, 50 C, 51 R, 5 KM; 335/42, 35, 45, 120, 160, 161, 121

[56] References Cited

U.S. PATENT DOCUMENTS

| | | | |
|---|---|---|---|
| 2,803,969 | 8/1957 | Hester | 74/483 X |
| 2,904,649 | 9/1959 | Ranson | 200/50 C |
| 3,137,775 | 6/1964 | Delaney | 200/50 C |
| 3,142,732 | 7/1964 | Clarke et al. | 200/50 C |
| 3,273,089 | 9/1966 | Franz | 200/50 C X |
| 3,472,974 | 10/1969 | McGaugh | 200/5 |
| 3,651,709 | 3/1972 | Booty et al. | 74/483 R |
| 4,041,260 | 8/1977 | Swindler et al. | 200/50 |
| 4,168,417 | 9/1979 | Puetz et al. | 200/50 C X |
| 4,400,599 | 8/1983 | Rickmann | 200/50 C |
| 4,516,100 | 5/1985 | Wallace et al. | 335/161 X |
| 4,620,077 | 10/1986 | Zdanys et al. | 200/331 |
| 4,626,638 | 12/1986 | Samples et al. | 200/331 |

FOREIGN PATENT DOCUMENTS

| | | |
|---|---|---|
| 1592692 | 6/1970 | France . |
| 2053499 | 4/1971 | France . |
| 2480993 | 10/1981 | France . |

*Primary Examiner*—William M. Shoop, Jr.
*Assistant Examiner*—Paul Ip
*Attorney, Agent, or Firm*—Kenyon & Kenyon

[57] ABSTRACT

Mechanical signals which are made available in the form of limited travel distances can be fed, for obtaining at least one output variable, to an arrangement in which plungers assigned to the input variable are arranged in space parallel to each other, wherein a slide movably guided likewise parallel to the plungers is provided for the transmsision of force between the plungers. For obtaining a logical AND interconnection, at least one plunger for a first input signal can be guided at the slide and at least one plunger can be arranged approximately opposite the former for the output signal and the slide an have a working surface for at least one corresponding plunger for action by a further input signal. Arrangements of this kind can be used in conjunction with wire tripping devices in electrical switching installations for interlocking purposes.

10 Claims, 4 Drawing Sheets

ARRANGEMENT FOR THE LOGICAL INTERLINKAGE OF MECHANICAL SIGNALS

BACKGROUND OF THE INVENTION

The present invention relates to an arrangement for the logical interlinkage of mechanical signals which are made available in the form of limited travel distances, for obtaining at least one output variable from one or more input variables.

Such arrangements which act purely mechanically in conjunction with electrical equipment or installations are frequently used, for instance, in order to permit the switching-on of a circuit only if certain safety measures have been taken first, for instance, the closing of a door or the mounting of a cover or the like. By using a mechanical interlinkage it is achieved that the desired dependencies are brought about automatically and without auxiliary electric energy. While also complicated dependencies can be achieved electrically or electronically, where the equipment or system parts to be brought into dependence can also be at a major distance from each other, such a safety system requires a multiplicity of sensors, positioning stages, lines and logical circuit elements as well as auxiliary electric energy which is always available. Therefore, such a safety system which can be designed circuit-wise for the most different dependencies, cannot be used if absolute availability is required.

SUMMARY OF THE INVENTION

It is therefore an object of the present invention to make the most important safety dependencies available by mechanical means, where immediate vicinity of the equipment or system parts to be brought into mechanical dependency is not a requirement, and high mechanical efficiency is to make it possible to take several conditions into consideration simultaneously.

The above and other objects of the invention are achieved by an arrangement for the logical interconnection of mechanical signals, which are made available in the form of limited travel distances, to obtain at least one output variable from one or several of the input variables, comprising a plurality of plungers assigned to the input variables and the output variables are arranged spatially parallel to each other, and slide means likewise guided parallel to the direction of motion of the plungers provided for transmitting force between the plungers.

The important property of this arrangement consists in that it can be used with slight modifications as a logical AND stage; as an OR stage or as an inverter, as will be explained in the following.

For all these embodiments it is advantageous to provide a frame, at which the slide is guided and which has openings for guiding organs of the plungers.

To obtain a logical AND interlinkage, at least one plunger for a first input signal can be guided at the slide and at least one plunger guided at the support can be arranged approximately opposite the former, and the slide can have a working surface for at least one plunger for action by a further input signal, which is likewise guided at the support. This arrangement operates in such a manner that a shift corresponding to the output signal of the plunger provided therefor comes about only if the plunger guided at the support, of the one input signal moves the slide and also the plunger which corresponds to the second input signal and is guided at the slide, is actuated. If such motions are required, this AND member can also be realized with double occupancy for the input signals and the output signals, so that the arrangenent comprises a total of six plungers.

An OR interlinkage can be obtained in such a manner that the slide has a working surface for two or more plungers for input signals as well as a further working surface for a plunger carrying output signals. The function consists in that the plunger for the output signal is always actuated by the slide if one of the plungers for the input signal is shifted.

A logically inverted signal can furthermore be obtained by the provision that one plunger each for an input 12 signal and a plunger for an output signal are arranged side by side; and that the slide has a working surface with each of the plungers and is acted upon by the force of a spring. The plunger is pre-tensioned for the output signal by this force, which corresponds to a positive output signal. If now a positive input signal is initiated by operating the corresponding plunger, the slide is shifted against the force of the spring and the plunger for the output signal is relieved. This corresponds to a signal reversal.

In dependence on the travel distances and the forces required to bring about the safety-wise interdependences, it can be advantageous to arrange between the slide and the plunger for the output signal a pivoted lever which influences the transfer ratio between the input variable and the output variable. By a relative shift of the opposite plungers, different transmission ratios can be achieved in this manner, since lever arms of different size become effective relative to the pivot of the lever. This arrangement is particularly well suited for th embodiment of the arrangement as an AND stage or an OR stage.

The plungers can be part of wire tripping devices, the threaded parts of which are fastened into openings of the support provided for this purpose. Such wire tripping devices are flexible transmission links which permit connecting also equipment or system parts which are not located immediately adjacent each other. In this manner, up to three circuit breakers as well as corresponding cell doors can be interlocked with respect to each other, for instance, in an electrical switching installation. In spite of the multiplicity of dependencies to be observed here, the total amount of 12 mechanical energy to be supplied is relatively small since the described logical arrangements operate with a high mechanical efficiency.

The arrangement according to the invention can be 16 designed uniformly for different functions in such a manner that the support is part of the housing, which has uniform dimensions for designing the equipment as an AND stage, 0R stage or as an inverter, and is provided with openings for fastening it as an individual equipment or for common fastening if the arrangement is in pairs or multiples. Such housing can then be mounted side by side or on top of each other.

BRIEF DESCRIPTION OF THE DRAWINGS

The invention will be explained in greater detail in the following, with reference to the drawings, in which:

FIG. 7 explains the symbols used in FIG. 6.

DETAILED DESCRIPTION

Figure 1:
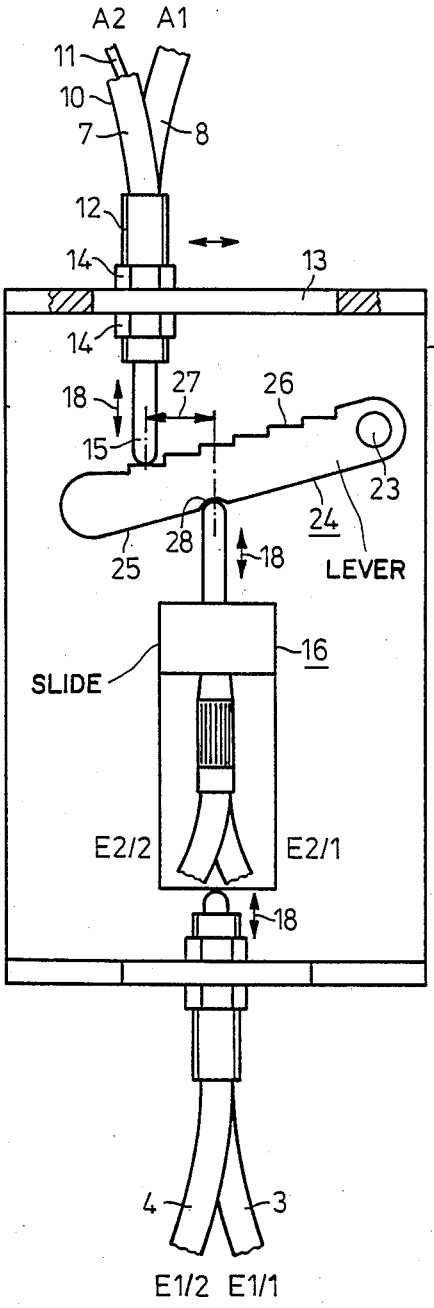
FIGS. 1 and 2 show an AND stage for two first and second inputs as well as two outputs in two views at right angles to each other.
Figure 2:
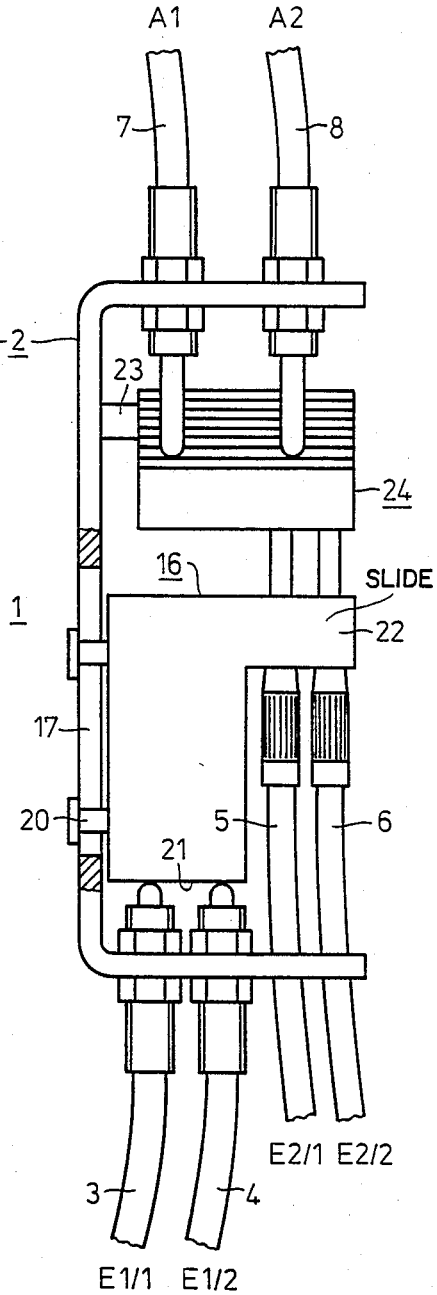

The AND stage 1 shown in FIGS. 1 and 2 comprises a frame-like support 2 to which a number of wire tripping devices are fastened. For the input variables E1/1 and E1/2, two wire tripping devices 3 and 4 are provided, while the further wire tripping devices 5 and 6 serve for feeding-in further input variables E2/1 and E2/2. With this total of four wire tripping 12 devices 2 to 6 are associated two further wire tripping devices 7 and 8 for output variables Al and A2. To this transmission member is connected a plunger guided in the end piece which protrudes from the opening of the end piece. In view of the 16 similar nature of the wire tripping devices, this arrangement will be explained only by the example of the wire tripping device 7. The flexible jacket is designated with 10 and the core guided therein with 11. 12 is the end piece which is provided with external thread, serves as the guide of the plunger 15, is brought out through an opening 13 of the support 2 and is secured relative to the latter by nuts 14. The plunger 15 which can be moved by actuation of the core 11 protrudes from the opening of the end piece 12. At the support 2, a slide 16 is movably guided in the same direction (arrow 18) in a suitable manner. The plungers of the wire tripping devices 3, 4, 5, 6, 7 and 8 can be moved via slide 16. In the example shown, the support 2 is provided with an elongated hole 17, through which mushroom-like pins 20 mounted on the slide 16 protrude. The slide 16 has a working surface 21 which faces the plungers of the wire tripping devices 3 and 4 which feed the input signal E1 to the arrangement. An angled-off arm 22 of the slide 16 supports the two further wire tripping devices 5 and 6 for the input signal E2. The plungers of these wire tripping devices, however, do not act directly on the plungers of the wire tripping devices 7 and 8 for the output signal A, but with the interposition of a lever 24 which is pivoted about a pin 23 and accordingly has, on its opposite sides, a working surface 25 for the plungers of the wire tripping devices 5 and 6 and a stepped working surface 26 for the plungers of the wire tripping devices 7 and 8. As is shown particularly in FIG. 1, there is a variable offset designated with 27 between the engagement points of the plungers on the opposite sides of the lever 24 which causes a travel distance transformation between the input signal and the output signal.

The arrangement shown in FIGS. 1 and 2 operates as follows. In the rest position, the parts assume the position shown under the influence of restoring forces. If, starting therefrom, the input variable E1/1 or E2/2 is fed-in by means of the wire tripping device 3 or the wire tripping device 4, the slide 16 is shifted in the direction toward the wire tripping devices 7 and 8 by action upon the working surface 21 by means of the corresponding plungers. Via the lever 24, a shift of the plungers of both wire tripping devices 7 and 8 associated with the output variable (A1 and A2) results. However, only a partial output signal is provided thereby. The complete output signal A is generated only if a further input signal E2/1 or E2/2 is introduced by one of the wire tripping devices 5 and 6 in addition to the action on the slide 16 by one or both wire tripping devices 3 and 4.

As is shown in FIGS. 1 and 2, the directions of motion of the plungers of all wire tripping devices are arranged parallel to each other. This brings about a substantially direct force transmission between the input variables and the output variables with the result of high mechanical efficiency. The latter is practically not affected adversely by the tiltable lever 24 since the play of the plungers of the wire tripping devices in the end piece guiding them is larger than the motion of the plungers relative to the lever due to the tilting of the lever 24, so that steps or flat depressions 28 can be provided in the working surfaces 25 and 26 of the lever 24 for receiving the rounded ends of the plungers. Such depressions are shown in FIG. 2 and are designated with 28.

Figure 3:
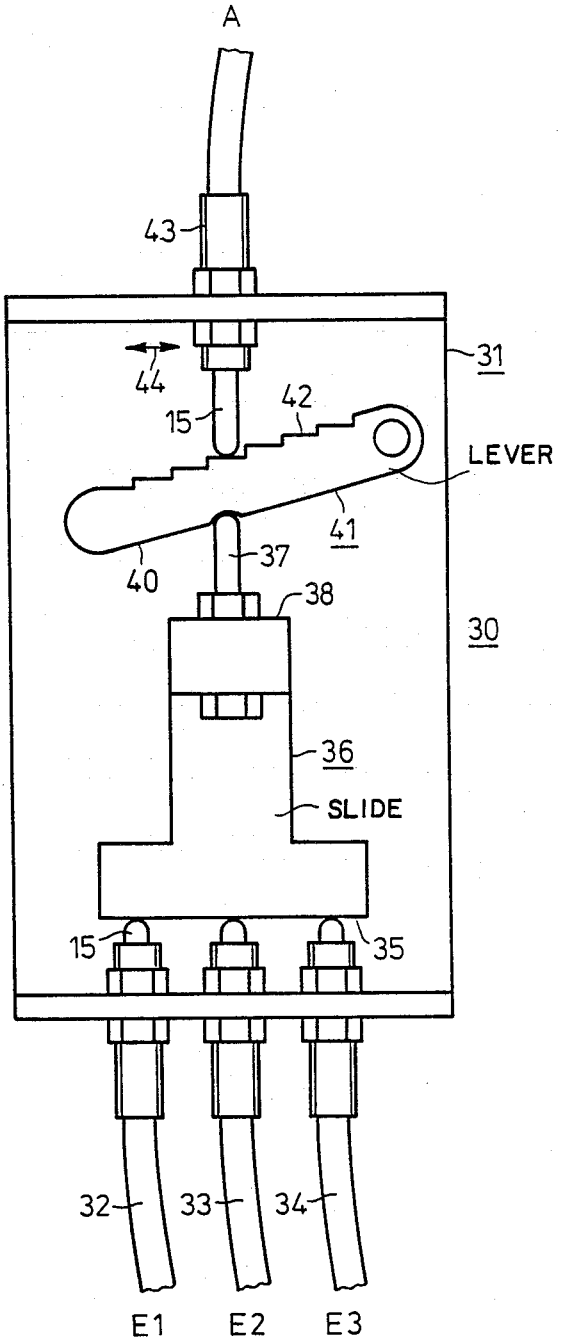
FIG. 3 shows an OR stage.

The OR stage 30 shown in FIG. 3 agrees in principle with the AND stage 1 explained above in that a support 31 for receiving wire tripping devices is provided. Input signals E1, E2 or E3 can be introduced selectably into the OR stage 30 through one of the wire tripping devices 32, 33 or 34. The plungers of these wire tripping devices are opposite a working surface 35 of a slide 36 which is guided, movably in a straight line at the support 31 and which has at its working surface 38 opposite the working surface 35 a firmly attached transmission pin 37. The latter cooperates with a working surface 40 of a pivoted lever 41, the working surface 42 of which, opposite the working surface 40 and designed with steps, serves for acting on the plunger of a further wire tripping device 43 associated with the output signal A. The generation of the output signal A can therefore be brought about by each of the wire tripping devices 32, 33 or 34. In the manner already described with the aid of FIGS. 1 and 2, a force or travel distance transformation can be brought about here within certain limits by the lever 41 by setting a displacement of the engagement point of the plungers at the working surfaces 40 and 42 as indicated by the arrow 44. For this purpose, the wire tripping device 43 can be fastened in the support 31 in different positions in the direction of the arrow 44.

If distance or force matching is not necessary, direct action of the slide 36 by means of its working surface 38 on the wire tripping device 43 can be provided, omitting the lever 41 and the plunger 37.

Figure 4:
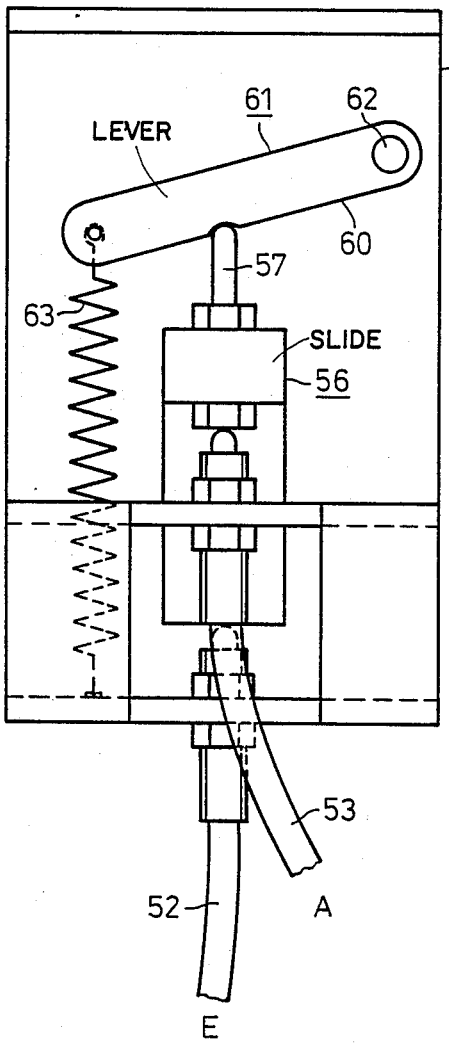
FIGS. 4 and 5 show an inverter, likewise in two views at right angles to each other.
Figure 5:
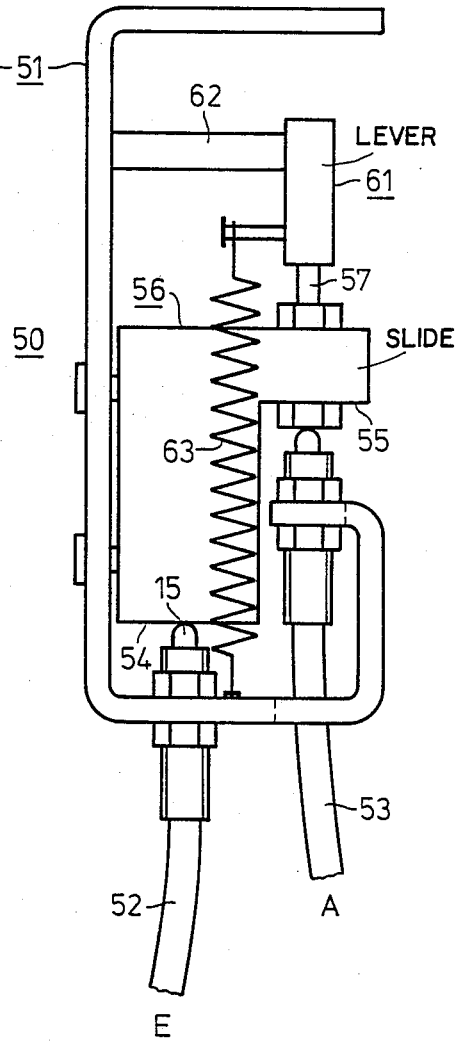

In agreement with the embodiments described above, the inverter 50 according to FIGS. 4 and 5 has again a framelike support 51. On the one side of the support are mounted side by side in parallel position, a wire tripping device 52 for an input signal E and a further wire tripping device 53 for passing-on an output signal A. The plungers of these wire tripping devices are opposite working surfaces 54 and 55 of a slide 56 which is movably guided at the support 51 in the manner described above. The slide 56 can correspond, for instance, to the slide 16 in FIGS. 1 and 2, precautions being taken that the working surfaces 54 and 55, offset relative to each other, can cooperate with the plungers by appropriate fastening of the wire tripping devices 42 and 43 at the support 51. On its side facing away from the working surfaces 54 and 55, the slide 56 in turn has a plunger 57 which rests against a working surface 60 of a lever 61 which pivots about a joint pin 62 and is under the action of a return spring 63. The force of this spring therefore loads both plungers of the wire tripping devices 52 and 53 in the base position according to FIGS. 4 and 5.

If, starting from there, the slide 56 is shifted in the direction of introducing an input signal E by means of the wire tripping device 52, the lever 61 is also set thereby and accordingly, the plunger of the wire tripping device 53 is relieved of the force of the spring 63. This corresponds to a reversal of the input signal.

In the following, an example for the use of logic arrangements of the type described above in an electric switching system is described making reference to FIG. 6. The switching installation contains three low-voltage circuit breakers 70, 71 and 72, of which the circuit breakers 70 and 71 are guided movably in plug-in carriers and can occupy accordingly an operating position and a test position. The doors of the switching cells, in which the plug-in carriers for the circuit breakers 70 and 71 are located, are likewise indicated schematically and are designated with 73 and 74. Each of the circuit breakers 70 and 71 and 72 has a symbolically indicated control shaft, the contact position of which, corresponding to the contact position of the circuit breakers, are designated with I for the on position and with 0 for the off position. Each of the circuit breakers has furthermore a transmission member which can be acted upon mechanically from the outside and a transmission member independent of the customary manual control elements for tripping the circuit breaker. These transmission members are designated with 75, 76 and 77.

The movable circuit breakers 70 and 71 located in the plug-in frame are provided with connections for flexible mechanical transmission members in the manner of wire tripping devices so that different signals for operation and the position of the circuit breakers can be taken off. In this manner, a signal for the on position E70, a signal for the off position A70, a signal for the test position T70, as well as a signal for the operating position B70, can be provided. Similarly, signals E71, A71, T71 and B71 can be derived.

Further signals are derived from the doors 73 and 74. For protection against manipulative intervention, always two signals are derived from different points at the doors or the stationary parts of the cell cooperating therewith. These signals which correspond to the closed state of the cell doors are designated with 273/1 and 273/2; and 274/1 and 274/2.

The signals explained above are fed to the logic arrangements with mechanical action of the type explained by means of FIGS. 1 to 5. For an understanding of the function provided for this purpose, FIG. 7 contains the explanations of the switching symbols used as well as the correlation and properties of the connections within the switching diagram. By a comparison with FIG. 6, it can therefore be stated that a total of seven AND stages U1, U2, U3, U4, U5, U6 and U7 are provided and furthermore, two inverters each, I1 and I2, as well as two OR stages 01 and 02. According to FIG. 7 it can likewise be seen that the connections between the circuit breakers 70, 71 and 72 as well as between the cell doors 73 and 74 and the mentioned logic arrangements are designed for different actuating frequencies in accordance with the occurring stresses. For the dashed and dashed-dotted connection, a design for a relatively small number of switching cycles is sufficient because, in conjunction with relatively rare position changes of the circuit breakers, they are related with relatively rare position changes within their plug-in franes. On the other hand, the connections shown by bold lines and the connections shown by dash-crossed lines are designed for a large number of switching cycles which is derived from the intended number of switching cycles of the circuit breakers. At the same time, FIG. 6 shows which connections are operative for the operating reliability of the switching installation and which of the connections are effective for the safety of the personnel.

Figure 6:
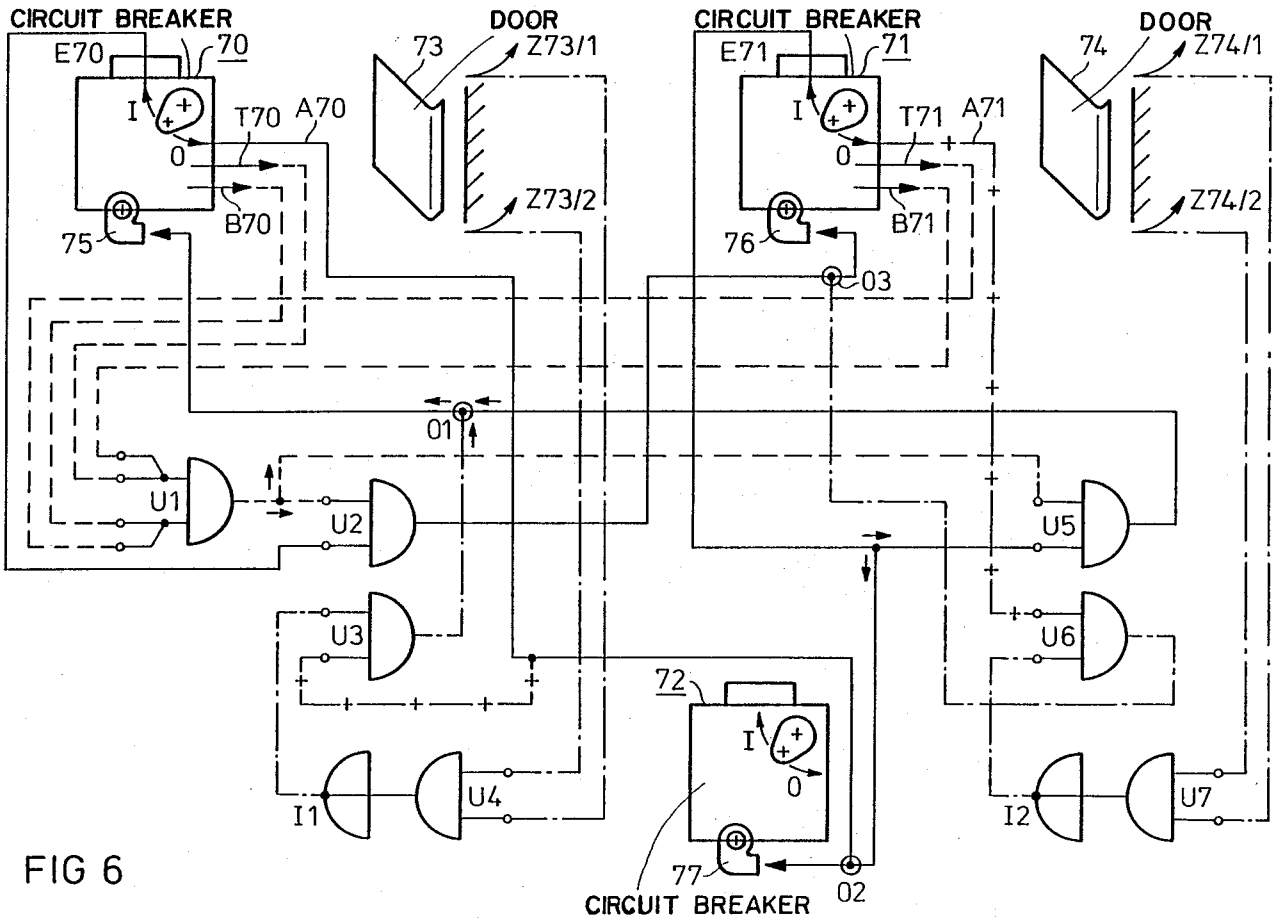
FIG. 6 shows a mechanical function diagram for interlocks within an electrical switching installation.

As an example for the dependencies shown in FIG. 6, the following switching state will be considered: the circuit breaker 70 is assumed to be in the operating position and is switched on. The circuit breaker 71 is further assumed to be in the operating machine position. Then, the AND member U1 becomes operative and furnishes an output signal to the AND stage U2. At the latter is present the signal E70 for the on position of the circuit breaker 70 so that an off signal is fed now to the actuating member 77 of the circuit breaker 71 by the AND stage U2. Therefore, the circuit breaker 71 cannot be switched on. Such an interlock may be desired, for instance, if the circuit breaker 70 is the main feed switch and the circuit breaker 71 is the emergency feed switch.

In the functional diagram according to FIG. 6, it is further assumed that the circuit breaker 72 has the purpose of a coupling switch which permits two bus bar systems to be connected to each other. If, however, the operation of the system is maintained by means of the circuit breaker 71 as an emergency feed switch, the bus bar systems must not be coupled in consideration of the smaller switching capacity of the emergency feed switch. To this end, the off signal A70 of the circuit breaker 70 and the on signal E71 of the circuit breaker 71 are fed to the OR stage, the output variable of which acts on the actuating member 77 of the circuit breaker 72. Thus, if one of the signals A70 and E71 is present, the circuit breaker 72 cannot be switched on.

Further dependencies will be seen without difficulty by making reference to the presentation in FIG. 6 and the corresponding explanations of the switching symbols in FIG. 7.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An arrangement for the logical interconnection of mechanical input signals which are made available in the form of limited travel distances, and for generating a least one output variable in the form of a limited travel distance from at least one of the input signals, comprising a plurality of plunger means each having a direction of motion and each assigned to respective ones of the input signals and the output signals, said plunger means being arranged spatially parallel to each other, and slide means guided parallel to the direction of motion of each of the plunger means provided for transmitting force between the plunger means, said slide means being guided independently of said plunger means whereby there is no rigid coupling of the slide means to the plunger means.

2. The arrangement recited in claim 1, wherein the slide means is guided in a support means which has openings for guiding members of the plunger means.

3. The arrangement recited in claim 1, wherein for obtaining a logical AND connection, at least one of the plunger means is associated with a first input signal and is guided on the slide means and at least one of the plunger means is provided opposite the slide means and is guided in the support means and associated with the output signal and the slide means has a working surface for action by a further input signal for at least one plunger means which is guided in the support means.

4. The arrangement recited in claim 1, wherein, for obtaining a logical OR interconnection, the slide means has a working surface for two or more of the plunger means associated with input signals and a further working surface for the plunger means associated with the output signal.

5. The arrangement recited in claim 1, wherein, for obtaining a logically inverted signal, one plunger means is provided associated with an input signal and another plunger means is provided associated with an output signal, said plunger means being arranged side by side, the slide means having a working surface for each of the plunger means, said slide means being acted upon by the force of a spring.

6. The arrangement recited in claim 2, further comprising a pivoted lever arranged between the slide means and the plunger means associated with the output signal for influencing the transmission ratio between the input signal and the output signal.

7. The arrangement recited in claim 2, wherein the plunger means are part of wire tripping devices having threaded sections fastened in openings of the support means.

8. The arrangement recited in claim 1, further comprising means for providing said arrangement in an electric switching installation in order to achieve safety-related dependencies between switching apparatus and/or locking or closing means of rooms or cells of the installation containing switching apparatus.

9. The arrangemet recited in claim 6, wherein the support means is part of a housing which, for an embodiment of the arrangement as an AND stage, OR stage or as an inverter, has uniform dimensions and is provided with openings for fastening as an individual device or for joint fastening in the case of a multiple arrangement.

10. The arrangement recited in claim 7, wherein the support means is part of a housing which, for an embodiment of the arrangement as an AND stae, OR stage or as an inverter, has uniform dimensions and is provided with openings for fastning as an individual device or for joint fastening in the case of a multiple arrangement.

* * * * *